US009996040B2

(12) United States Patent
Zaima

(10) Patent No.: US 9,996,040 B2
(45) Date of Patent: Jun. 12, 2018

(54) IMAGE FORMING APPARATUS

(71) Applicant: CANON KABUSHIKI KAISHA, Tokyo (JP)

(72) Inventor: Nobuhiko Zaima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/295,216

(22) Filed: Oct. 17, 2016

(65) Prior Publication Data

US 2017/0123361 A1 May 4, 2017

(30) Foreign Application Priority Data

Oct. 30, 2015 (JP) ..... 2015-213694

(51) Int. Cl.
*G03G 15/00* (2006.01)
*G03G 15/08* (2006.01)

(52) U.S. Cl.
CPC ..... *G03G 15/556* (2013.01); *G03G 15/0848* (2013.01)

(58) Field of Classification Search
CPC ..... G03G 15/553; G03G 15/556; G03G 15/0848; G03G 15/0839; G03G 15/0877; G03G 15/0879
See application file for complete search history.

(56) References Cited

U.S. PATENT DOCUMENTS 6,898,384 B2 * 5/2005 Katoh ..... G03G 15/065 399/27
2003/0228164 A1 * 12/2003 Katoh ..... G03G 15/0853 399/30
2011/0164888 A1 * 7/2011 Kubo ..... G03G 15/0266 399/27
2011/0211852 A1 * 9/2011 Obara ..... G03G 15/0822 399/49
2015/0110509 A1 * 4/2015 Yagyu ..... G03G 15/0848 399/53
2015/0277288 A1 * 10/2015 Murayama ..... G03G 15/0889 399/44

FOREIGN PATENT DOCUMENTS

JP 2001-042613 A 2/2001

* cited by examiner

*Primary Examiner* — Carla Therrien
(74) *Attorney, Agent, or Firm* — Fitzpatrick, Cella, Harper & Scinto

(57) ABSTRACT

Image formation is properly performed by suppressing an influence on a transfer property in the image formation due to variation in a toner particle charge amount. An image forming apparatus comprises a developing device for performing development using developer including a charged toner particle, a toner supply container for supplying the toner particle to a development unit, and a CPU for controlling a toner particle amount supplied to the developing device. The CPU calculates a toner consumption amount consumed by the development. Then, from the result, the CPU calculates a toner supply amount which makes the toner charge amount in the developing device constant. Then, the CPU supplies the toner of the calculated amount to the developing device.

10 Claims, 10 Drawing Sheets

IMAGE FORMING APPARATUS

BACKGROUND OF THE INVENTION

Field of the Invention

The present disclosure relates to an image forming apparatus which performs development by adhering a toner particle to a latent image and an image forming method.

Description of the Related Art

Conventionally, an image forming apparatus which performs image formation on a desired sheet is known. To perform the image formation, various methods are proposed. One of the known methods is charging a toner particle and using an electrostatic force to perform the image formation. With an image forming apparatus of an electrophotographic apparatus type employing this method, when a charge amount of the toner particle (or toner particle charge amount) changes, density and quality of an output image accordingly change. The toner particle charge amount changes in accordance with various conditions such as a use environment, the density of the output image and output elapsed time. Thereby, if no control to stabilize the output is performed, the output image varies in accordance with the condition.

Further, an electrophotographic type image forming method using a two-component developing device, or a method to perform the image formation using the toner particle and a carrier particle as a developer is also known. With the image forming apparatus employing this method, a toner consumption amount is predicted from the image data. Then, the image forming apparatus supplies the toner which is almost the same amount with the toner consumption amount as predicted. It is also known to control or adjust the toner supply amount using an output value of an inductance sensor and the like which measures a density of the toner particle in the developer from a difference in magnetic permeability between the toner particle and the carrier particle in the developer.

In the two-component developing device, generally, the toner particle charge amount changes depending on a mixing ratio of the toner particle and the carrier particle in the developing device. As the ratio of the toner particle reduces, the toner particle charge amount increases. In a case where the toner particle charge amount increases, the toner particle adhering to a constant charged latent image reduces. On the contrary, in a case where the toner particle charge amount reduces, the toner particle adhering to the constant charged latent image increases.

Thereby, it is possible to stabilize the toner particle charge amount and the density of the output image by adjusting the toner particle supply amount and changing the mixing ratio of the toner particle and the carrier particle in the developing device. To this end, conventionally, a patch image for output density measurement is output. Then, patch density and the toner amount are obtained on an image carrier, on a transfer body and the like. Feedback control, through which the toner supply amount is controlled so that the output density matches with target density based on the obtained patch density and the toner amount, is well known. Through the control, in addition to the toner supply amount in accordance with the image data or the supply amount adjustment by the inductance sensor, the toner is also supplied based on the adjusted toner supply amount calculated based on the density of the output patch image. As a result, the toner charge amount and the toner density can be adjusted.

A control mechanism for stabilizing the density of the output image by adjusting the toner supply amount based on the output result of the patch image is the feedback control through which various adjustments are performed after measuring the patch density or the toner amount. Thereby, in principle, a delay is caused in control. Further, it takes time before the toner particle charge amount changes by following the toner supply adjustment so that delay is inevitably caused in control, which causes density deviation in a short period. To solve such problem, Japanese Patent Application Publication Laid-Open No. 2001-42613 discloses a technology to perform feed forward control through which, to stabilize the image density, the toner particle charge amount is estimated and a contrast potential in the image formation is restrained in real time.

In the feed forward control as mentioned, however, it sometimes causes a problem in that it is not possible to sufficiently suppress an influence due to the change of the toner particle charge amount. In an electrophotographic technology, the image is formed using electrostatic force. Thereby, it is desired that the toner particle charge amount remains as unchanged as possible. However, in a case where the contrast potential in the image formation is adjusted based on a prediction of the toner particle charge amount, regardless of a value of the toner particle charge amount, an adjustment is performed so that a toner developing amount to the image carrier is maintained constant. As a result, the toner particle charge amount remains different from the toner particle charge amount which corresponds to intended image density in value. Thereby, in a subsequent step, in a case where there is a step which gives influence on a transfer property in the image formation due to the variation in the toner particle charge amount, the image formation may not properly be performed.

Further, in a transfer step, in a case where the toner particle charge amount is different from the charge amount corresponding to the intended image density in value, to perform a proper transfer, the toner particle charge amount is insufficient or too much. As a result, the transfer property is changed so that the image density or quality is deteriorated. In particular, this is largely influenced when using a secondary color/tertiary color on which toner of one or more colors are overlapped.

SUMMARY OF THE INVENTION

According to the present invention, there is provided an image forming apparatus comprising: a photoreceptor; an exposure unit configured to expose the photoreceptor based on image data to form an electrostatic latent image on the photoreceptor; a developing unit, having a rotating member configured to rotate to charge a developer including toner, configured to develop the electrostatic latent image formed on the photoreceptor using the developer; a detecting unit configured to detect a density of the toner in the developing unit; a supply unit configured to supply toner to the developing unit; and a controller configured to determine consumption amount of the toner based on the image data and control the supply unit so that a change amount of a charge amount of the developer in the developing unit is within a predetermined range based on rotation time of the rotating member, a detection result of the detecting unit and the consumption amount.

Further features of the present invention will become apparent from the following description of exemplary embodiments (with reference to the attached drawings).

DESCRIPTION OF THE EMBODIMENTS

Figure 1A:
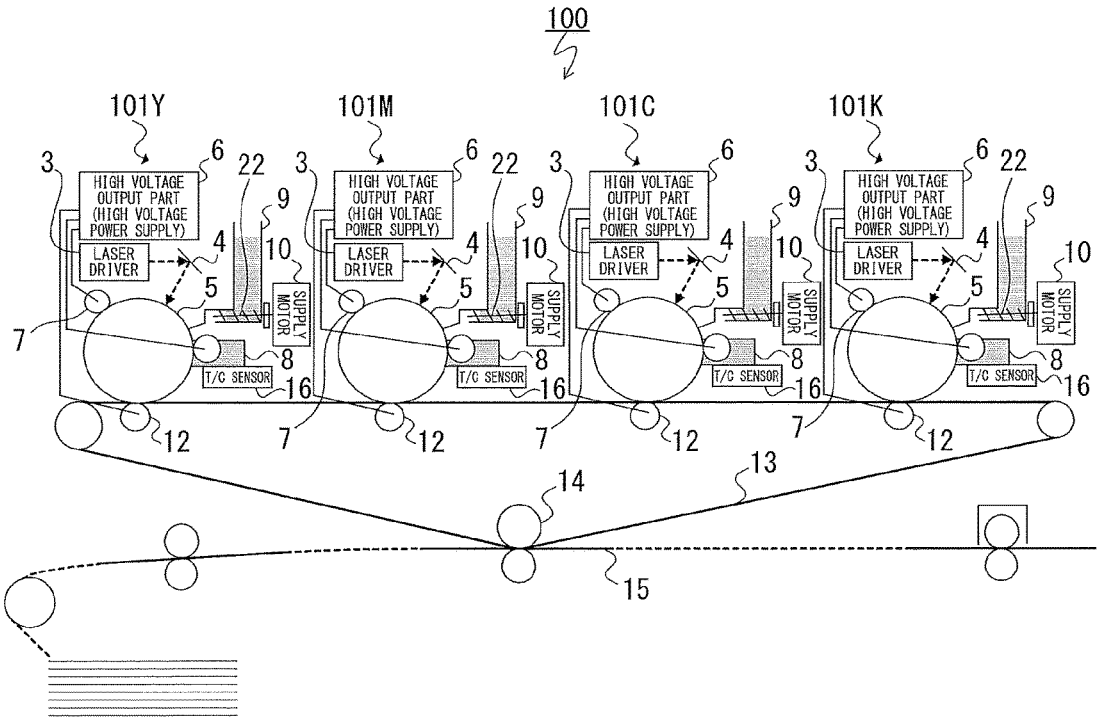
FIG. 1A is a schematic diagram showing an overall configuration of an image forming apparatus according to a first embodiment.
Figure 1B:
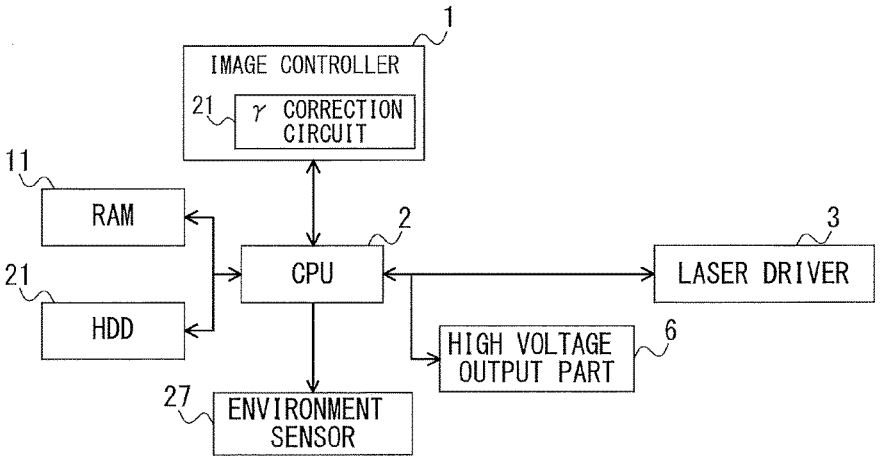
FIG. 1B is a functional block diagram of the image forming apparatus according to the first embodiment.

In a first embodiment described below, a description is provided with regard to the first embodiment of the present disclosure. FIG. 1A shows a schematic diagram showing an overall configuration of an image forming apparatus 100 adapting the present disclosure. Further, FIG. 1B shows a functional block diagram of the image forming apparatus 100. As shown in FIG. 1A, the image forming apparatus 100 comprises image forming stations 101Y, 101M, 101C and 101K which respectively perform image formation of yellow, magenta, cyan and black. The image forming station 101Y comprises a laser driver 3, a reflection mirror 4, the photosensitive drum 5, a high voltage output part 6, a charging roller 7, the developing device 8, a developer container 9, a supply motor 10 and a conveying screw 22. The image forming station 101Y also comprises a primary transfer device 12 and a toner density sensor 16. The configuration of the image forming stations 101M, 101C and 101K is similar to that of the image forming station 101Y except for the color to be formed so that the description is omitted. The image forming apparatus 100 also comprises a secondary transfer device 14 which transfers an image to a sheet on which the image is transferred. In the present embodiment, a sheet 15 is used as the sheet. As shown in the fictional block diagram in FIG. 1B, the image forming apparatus 100 comprises an image controller 1 and a CPU as a central processing unit. Further, the image forming apparatus comprises the high voltage output part 6, a random access memory (RAM) 11 and a hard disk drive (HDD) 21. Further, the image forming apparatus 100 comprises an environment sensor 27 for detecting temperature and humidity in the image forming apparatus 100. The laser driver 3, the high voltage output part 6, the RAM 11 and the HDD 21 are connected to the CPU 2.

In the following, unless otherwise stated, the CPU 2 controls the operation of the image forming apparatus 100. The CPU 2 receives image data which is described in a specific description language via the image controller 1 from a host computer, not shown (hereinafter referred to as PC (Personal Computer)). Then, the CPU 2 generates image forming data from a received electric signal. Then, the CPU 2 performs signal processing for generating a latent image by the laser driver 3 of the image forming apparatus 100 main body and sends the signal to the laser driver 3. The laser driver 3 converts the above electric signal into an optical signal. Then, the laser driver 3 emits the optical signal to a polygon mirror mounted to a motor which rotates at a high speed (not shown). The optical signal reflected by the polygon mirror is irradiated on a surface of the photosensitive drum 5 which is a latent image carrier by the reflection mirror 4.

The photosensitive drum 5 is charged at a predetermined potential by the charging roller 7 to which a voltage is applied from the high voltage output part 6. By receiving the light irradiation, a surface potential of the photosensitive drum 5 changes and an electrostatic latent image is formed on the photosensitive drum 5. At this time, the photosensitive drum 5 is charged with a voltage value controlled by the high voltage output part 6. The image forming apparatus 100 of the present embodiment negatively charges the photosensitive drum 5 and negatively charges the toner particle to adhere the toner particle to a part (bright part) at which the light irradiation is performed. Further, as the photosensitive drum 5 is charged using the charging roller 7 so that the photosensitive drum 5 becomes a predetermined potential, the potential of the bright part at which the toner is developed changes depending on light intensity emitted from a laser diode. It means that it is possible to adjust a toner development amount by controlling a light irradiation amount to the photosensitive drum 5.

Figure 2:
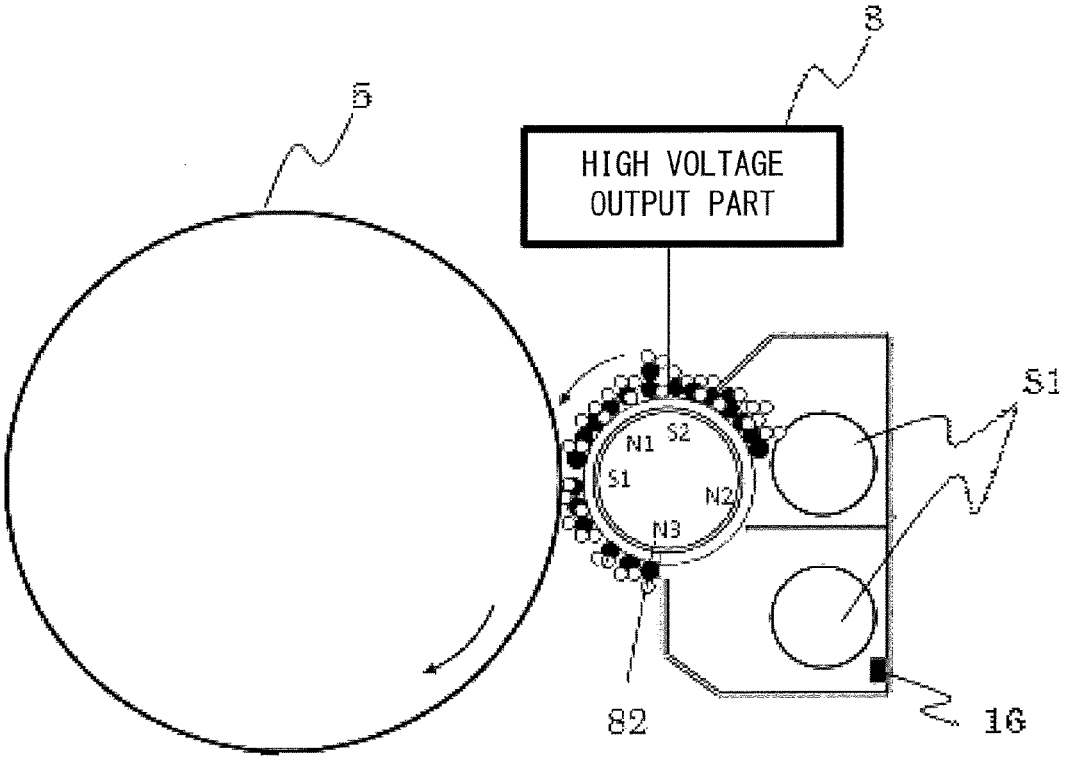
FIG. 2 is a cross sectional showing a main part of a photosensitive drum 5 and a developing device 8.

FIG. 2 is a cross sectional view of a main part of the photosensitive drum 5 and the developing device 8. The developing device 8 stores the two-component developer containing the toner and carrier. The developing device 8 also comprises a stirring screw 81 which stirs the stored developer and a developing roller 82 as a developer carrier which carries the developer. The developer container 9 accumulates the toner for supplying to the developing device 8. To supply the toner from the developer container 9 to the developing device 8, the supply motor 10 rotates the conveying screw 22. The supply amount is determined by the rotation speed of the conveying screw 22. The stirring screw 81 stirs the developer so that the developer in the developing device 8 is frictionally charged. The developer in the developing device 8 is conveyed by the developing roller 82 to a developing position at which the photosensitive drum 5 and the developing roller 82 are opposite to each other. The toner in the developer carried by the developing roller 82 is electrostatically adhered to the photosensitive drum 5. The electrostatic latent image formed on the photosensitive drum 5 is then visualized as a toner image. It is noted that a developing bias voltage controlled by the high voltage output part 6 is applied to the developing roller 82.

Referring to the image data to be output and based on a consumption amount which is calculated from the image data, the CPU 2 controls the operation of the stirring screw 22 through the supply motor 10. As a result, among the toner in the developer container 9, toner of a required amount is supplied to the developing device 8. Thereby, in the present embodiment, a supply unit is configured by the supply motor 10 and the stirring screw 22. In calculating the consumption amount, the image signal is converted into the consumption amount using a predetermined table previously stored. In the table, relation between the image signal per pixel and the toner consumption amount is shown. Then, an integrated value per unit time of the converted consumption amount (video count value) is used as the consumption amount.

Figure 3:
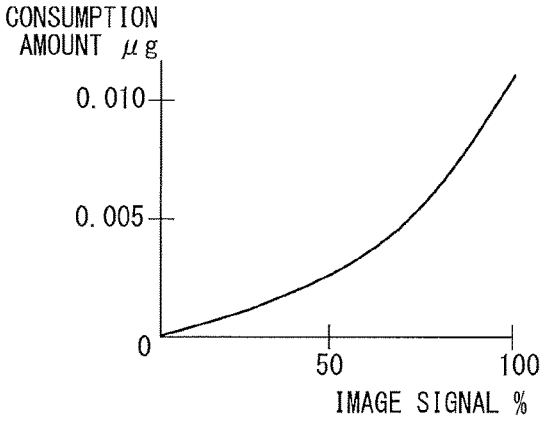
FIG. 3 is a graph showing a relation between an image signal and a consumption amount in the first embodiment.

FIG. 3 is a graph showing relation between the image signal and the consumption amount in the present embodiment. The toner density of the two-component developer, i.e., the mixing ratio of the toner and the carrier gives influence on the toner particle charge amount. Thereby, in general, the toner is supplied so that the toner density is maintained. In the present embodiment, however, to stabilize the developing property and the transfer property, the CPU 2 adjusts the toner supply amount from the developer container 9 to the developing device 8 to maintain the toner particle charge amount constant based on the prediction of the toner particle charge amount which is described later.

In general, the toner supply amount is determined by a difference between detected toner density D and target toner density Dt which is previously set and the supply amount based on the consumption as mentioned. In the present embodiment, however, to stabilize the developing property and the transfer property, the CPU 2 adjusts the toner supply amount to the developing device 8 based on the prediction of the toner particle charge amount which is described later to control to suppress the variation in the toner particle charge amount. In the present embodiment, the CPU 2 controls so that the toner particle charge amount has a constant value. The toner image is transferred to an intermediate transfer belt 13 by the primary transfer device 12 provided below the photosensitive drum 5 of a downstream side of the developing device 8. Thereafter, the toner image is further transferred to a surface of the sheet 15 by the secondary transfer device 14.

The sheet 15 on which the toner image is transferred is conveyed by a recording paper conveying roller. Then, with a fixing device, the above toner image is fixed on the sheet 15 and conveyed outside the image forming apparatus 100. In the present embodiment, the CPU 2 estimates the toner consumption amount, the toner supply amount and the toner amount in the developing device 8 to predict a change (A) in the toner particle charge amount. Further, the toner particle charge amount prediction is calculated for every time step. The calculation formula is shown as below.

$$\Delta R = TC - TCprec = (\alpha - TCprec)*(\text{calculation time step}/\beta) + (HTC*\text{supply amount} - TCprec*\text{consumption amount})/\text{toner amount in developing device 8} \quad (2)$$

$$\Delta S = TCpret - \gamma * TCpret \quad (3)$$

ΔR: Change amount of the toner particle charge amount when the developing roller is rotated TC: Toner particle charge amount TCprec: Toner particle charge amount at the previous calculation α: Toner particle saturated charge amount β: Time speed at which the friction charge (electrostatic discharge) is performed HTC: Supplied toner particle charge amount ΔS: Change amount of the toner particle charge amount when the developing roller is stopped TCpret: Toner particle charge amount at the previous time step The formula (2) represents ΔR, the change amount of the toner particle charge amount when the developing roller is rotated. A first term of a right side in the formula (2) is "(α−TCprec)*(calculation time step/β)". This shows an "amount that the charge of the toner particle changes by the friction charge". A second term of the right side of ΔR is "(HTC*supply amount−TCprec*consumption amount)/toner amount in developing device". This shows an "increase amount of the charge amount when uncharged toner particle is supplied at the same time as the charged toner particle is developed". The uncharged toner particle is not necessarily supplied exactly at the same time as the charged toner particle is developed. The uncharged toner particle may be supplied after the charged toner particle is developed. Addition of the first term and the second term is ΔR, which is a formula to predict the charge amount in the next step. While the stirring screw 81 is being rotated, the CPU 2 calculates the change in the charge amount for every time step based on the formula (2). In the following, a description is provided with regard to a method to calculate the change amount of the charge amount for every time step. Instead, the change amount of the charge amount may be calculated based on the time measured before printing one sheet of image by measuring, by the CPU 2, time during which the stirring screw 81 is being rotated and being stopped. γ represents a parameter showing time speed of charge leakage from the toner particle. γ is a coefficient which is larger than 0 and smaller than 1. γ is properly determined by an experiment. The formula (3) represents ΔS, the change amount of the toner particle charge amount when the developing roller is being stopped. This is the calculation formula showing that the charge amount is attenuated. While the stirring screw 81 is not being rotated, the CPU 2 calculates the change amount of the charge amount for every time step based on the formula (3). By storing the integrated value of the change amount, the toner particle charge amount can be obtained. Further, an initial value of the toner particle charge amount is set to 0. The charge amount per toner unit weight (hereinafter, referred to as toner tribo) is also set to 0.

In the present embodiment, using the above prediction, the CPU 2 determines the supply amount so as to prevent a change of the toner particle charge amount (Δ) between each time step. The supply amount is adjusted by changing, by the CPU 2, the rotation speed of the supply motor. In this control, the toner supply amount is determined to be a value which does not change the toner particle charge amount. Thereby, at this point, the toner consumption amount and the supply amount differ in the amount so that the toner density changes.

The toner density can be calculated by the following formula from a difference between the consumption amount and the supply amount with respect to the developing amount.

$$D = (\text{previous toner amount-consumption amount} + H)/(\text{carrier amount+previous toner amount-consumption amount} + H) \quad (4).$$

D: Toner density

H: Supply amount

Further, each parameter of α and β in the toner particle charge amount prediction formula as mentioned can be expressed by the following formula.

$$\alpha=a/(1+b)D,\ \beta=cD+d \quad (5)$$

In the formula (5), a, b, c, and d are parameters which are previously determined in accordance with a charge property of the toner. The values of a, b, c, and d are obtained from decrease amount data of the charge amount by the friction charge in a case where the toner density is previously changed by the experiment.

Figure 4:
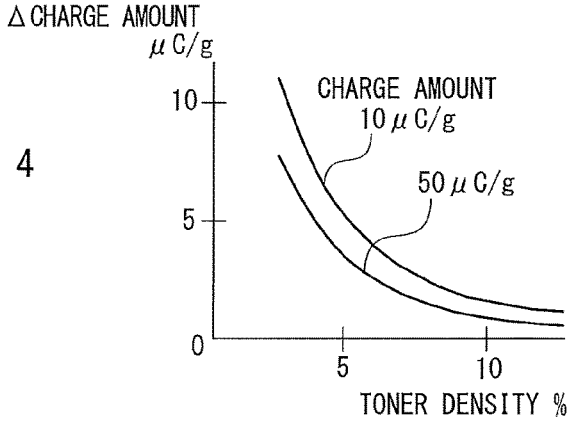
FIG. 4 is a graph showing a relation between the toner density and a decrease amount of the charge amount in the first embodiment.

FIG. 4 is a graph showing relation between the toner density and the decrease amount of the charge amount in the present embodiment. In FIG. 4, a horizontal axis represents the toner density and a vertical axis represents the decrease amount of the charge amount (amount that the toner particle charge amount changes by the friction charge: Δ charge amount). As shown in the graph in FIG. 4, the Δ charge amount is different in values in cases where the toner particle charge amount is 10 μC/g and 50 μC/g. Even in this case, however, each parameter of a, b, c, and d shown in the formula (5) does not change as long as the charge property by a physical property of the toner and the carrier is identical to a stirring configuration by the developing device.

Due to this, it can be found that, when the toner density D changes, even in a case where the toner consumption amount and the supply amount are the same, the change amount in the toner particle charge amount also changes. When the toner density changes, a contact opportunity between the toner and the carrier by the stirring also changes. This is because charging ability by the friction charge changes. That is, in the consecutive toner particle charge amount predictions, in a case where the change in the toner particle charge amount (Δ) with respect to the output of the same image data is predicted in the next time step, the toner density is changed as compared to that of the previous step. As a result, the toner supply amount which prevents the change of the toner particle charge amount is different from the supply amount in the previous step in value.

In particular, when the supply amount is reduced so that the toner density is lowered, α increases and β decreases. Thereby, the charge amount between the time steps increases. As a result, the toner supply amount to prevent the change of the charge amount between the time steps will increase. On the contrary, when the supply amount is large, α decreases and β increases. The charge amount is reduced so that the supply amount is reduced. In this manner, in the present embodiment, the charge amount is changed to suppress the change in the toner density. Thereby, even the supply amount is differentiated from the consumption amount to maintain the charge amount constant, the toner density does not keep deviating. It converges to a certain value to the image data.

Figure 5:
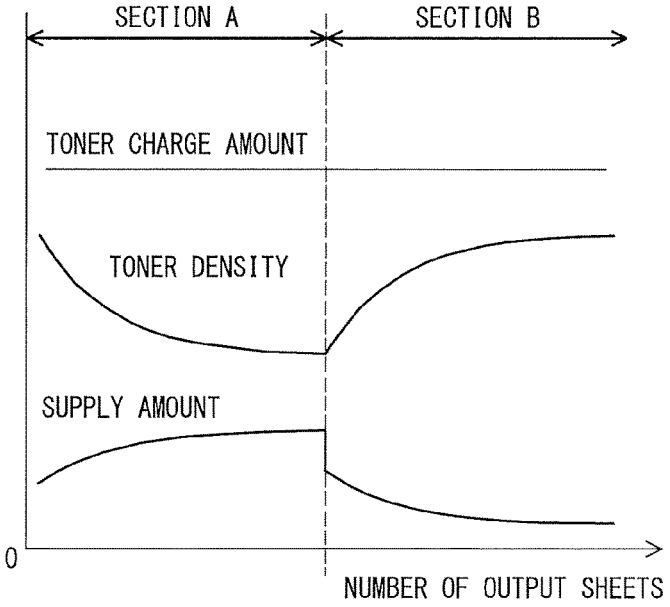
FIG. 5 is a diagram showing a control image by the toner supply amount adjustment in the first embodiment.

FIG. 5 shows a graph representing the adjustment of the toner supply amount in the present embodiment. In the following, referring to FIG. 5, a description is provided in detail with regard to adjustment control of the toner supply amount. In FIG. 5, with the horizontal axis as the number of output sheets, three graphs are shown. In the above position, a graph representing correlation of the toner particle charge amount with respect to the number of output sheets is shown. In the middle position, a graph of the toner density D with respect to the number of output sheets is shown. In the below position, a graph showing the toner supply amount between the time steps with respect to the number of output sheets is shown. As mentioned, in each graph, the horizontal axis represents the number of output sheets. Further, in a section A where the number of output sheets is less than the predetermined number of sheets, the image data with a high image ratio (the toner consumption amount is large) is output. In a section B where the number of output sheets exceeds the predetermined number of sheets, the image data with a low image ratio (the toner consumption amount is small) is output.

The toner consumption amount is large in the section A, which requires increasing the toner supply amount. However, if the toner supply amount in the developing device 8 increases, the uncharged toner increases. As a result, the increase amount of the charge amount of the second term in the formula (2) which represents ΔR turns largely negative. This is because the "consumption amount" becomes large in the second term of the right side in the formula (2), "(HTC*supply amount−TCprec*consumption amount)/toner amount in developing device 8" which represents the "increase amount of the charge amount when the uncharged toner particle is supplied at the same time as the charged toner particle is developed". Thereby, a total with the first term of the right side in the formula (2) of "(α−TCprec)*(calculation time step/β)", representing the decrease amount of the charge amount by the friction charge, also turns negative. That is, the total of the first term and the second term of the right side in the formula (2) turns negative.

Thereby, the supply amount is reduced to balance with the decrease amount of the charge amount in the first term and the increase amount of the charge amount in the second term to prevent the change of the toner particle charge amount between the time steps. Thereby, the toner density is lowered in the section A, however, the more the toner density is lowered, the more the decrease amount of the charge amount increases. Due to this, it becomes possible to increase the supply amount for every increase of the number of output sheets. As a result, the lowered amount in the toner density decreases. The toner density is converged into a value which balances the increase amount of the charge amount due to entering and exiting the toner with the decrease amount of the charge amount by stirring the toner.

When the image data changes in the section B, the toner consumption amount changes so that the relation between the increase amount of the charge amount and the decrease amount of the charge amount changes. In the section B, the toner consumption amount is small so that the increase amount of the charge amount reduces. So, in the formula (2), the second term of the right side becomes smaller than the first term of the right side, which increases the charge amount. Thereby, the toner supply amount is set larger than the consumption amount to prevent the change of the charge amount. Due to this, the toner density increases in the section B, however, it does not keep increasing. Similar to the case in the section A, it converges to a value which is in accordance with the image data.

Figure 6:
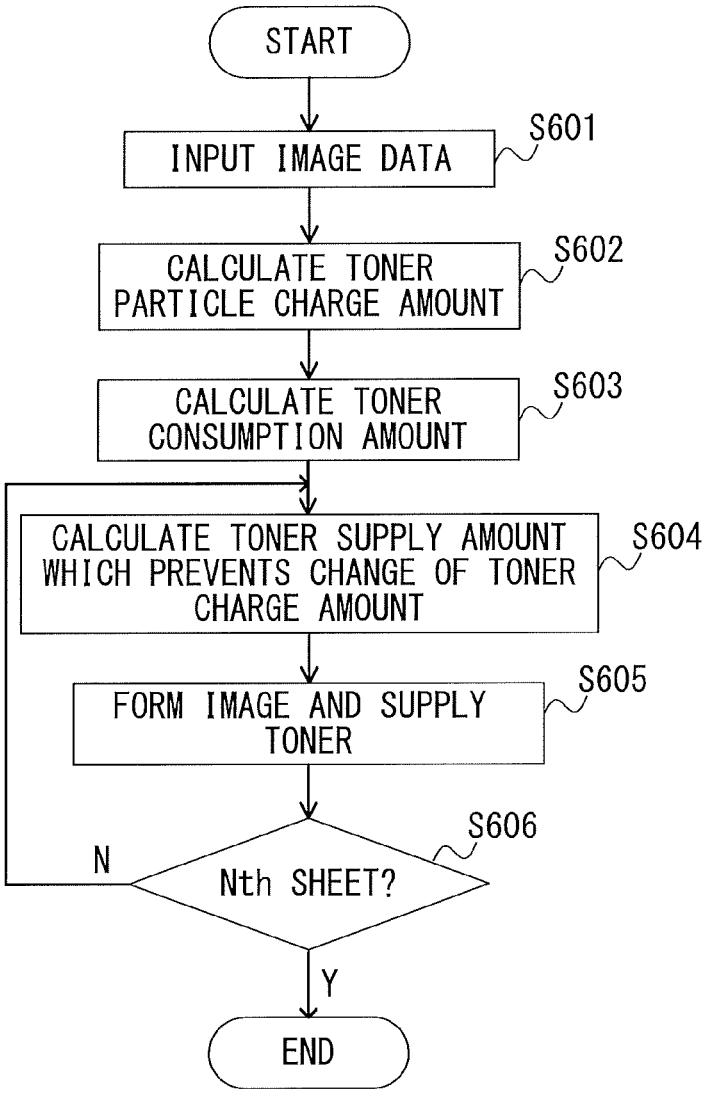
FIG. 6 is a flowchart showing an operation flow of the supply amount adjustment in the first embodiment.

Next, operation flow of the supply amount adjustment by the change amount prediction of the toner particle charge amount of the present embodiment is described using the flowchart shown in FIG. 6. In FIG. 6, when the image data is input into the image controller 1 from the PC (Step S601), the CPU 2 calculates the toner particle charge amount at that point based on an integrated value of the change amount prediction (Step S602). In the present embodiment, the image data of N number of sheets is output. At this time, as the toner density D, a previous actual measurement value is used. Next, using the graph showing the relation between the image signal and the consumption amount in FIG. 3, the CPU 2 calculates a toner consumption amount S in outputting the image data (Step S603). Thereafter, referring to the formula (2) which predicts the change in the toner particle charge amount, the CPU 2 calculates the supply amount which prevents the change of the charge amount in outputting the image data (Step S604). The supply amount for the image of the first sheet is calculated as H(1).

After determining the supply amount, the CPU 2 forms the image and supplies toner (Step S605) and determines whether the image data is for the Nth sheet or not (Step S606). If it is determined that the image data is not for the Nth sheet (Step S606: N), the CPU 2 returns to the processing of Step S604. In the Step S604, the supply amount for the image of the second sheet, the third sheet, and the Nth sheet is respectively calculated as H(2), H(3) and H(N). Further, when determining the supply amount of the image from the first sheet to the Nth sheet, the consumption amount S does not change.

After forming the image in a case where it is determined that the image data is for the Nth sheet (Step S606: Y), the CPU 2 ends the processing. Note that unless the image data changes, the consumption amount S does not change. Here, for convenience, after outputting the image, the supply amount for the next image is calculated, however, the supply amount may be calculated one after another before the previous image is output.

As mentioned, in the present embodiment, the charge amount in the toner particle can be maintained constant by adjusting the supply amount to prevent the change of the charge amount by using the formula which predicts the change in the charge amount. So, in the secondary color/tertiary color, stable and high quality output can be realized. In particular, a case where the image formation is performed by a conventional method in which the image formation potential contrast is changed from the prediction of the toner particle charge amount, is compared with a case where it is performed by the method in accordance with the present embodiment. In the comparison, after outputting 1000 sheets with a high image ratio (C: 100%, M: 100%), 1000 sheets with a low image ratio (C: 5%, M: 5%) are output. Color deviation for a single color (C, M) at this time is about ΔE=2.5 in the conventional method and in the method in accordance with the present embodiment, which does not have any difference therebetween. On the other hand, with regard to the secondary color (Blue), in the conventional method, the color deviation ΔE=5, whereas in the method in accordance with the present embodiment, it is improved to ΔE=3. The color deviation ΔE is calculated by the following method.

$$\Delta E=(\Delta L^{*2}+\Delta a^{*2}+\Delta b^{*2})^{0.5}$$

(CIE L*a*b*value in color space)

Figure 7:
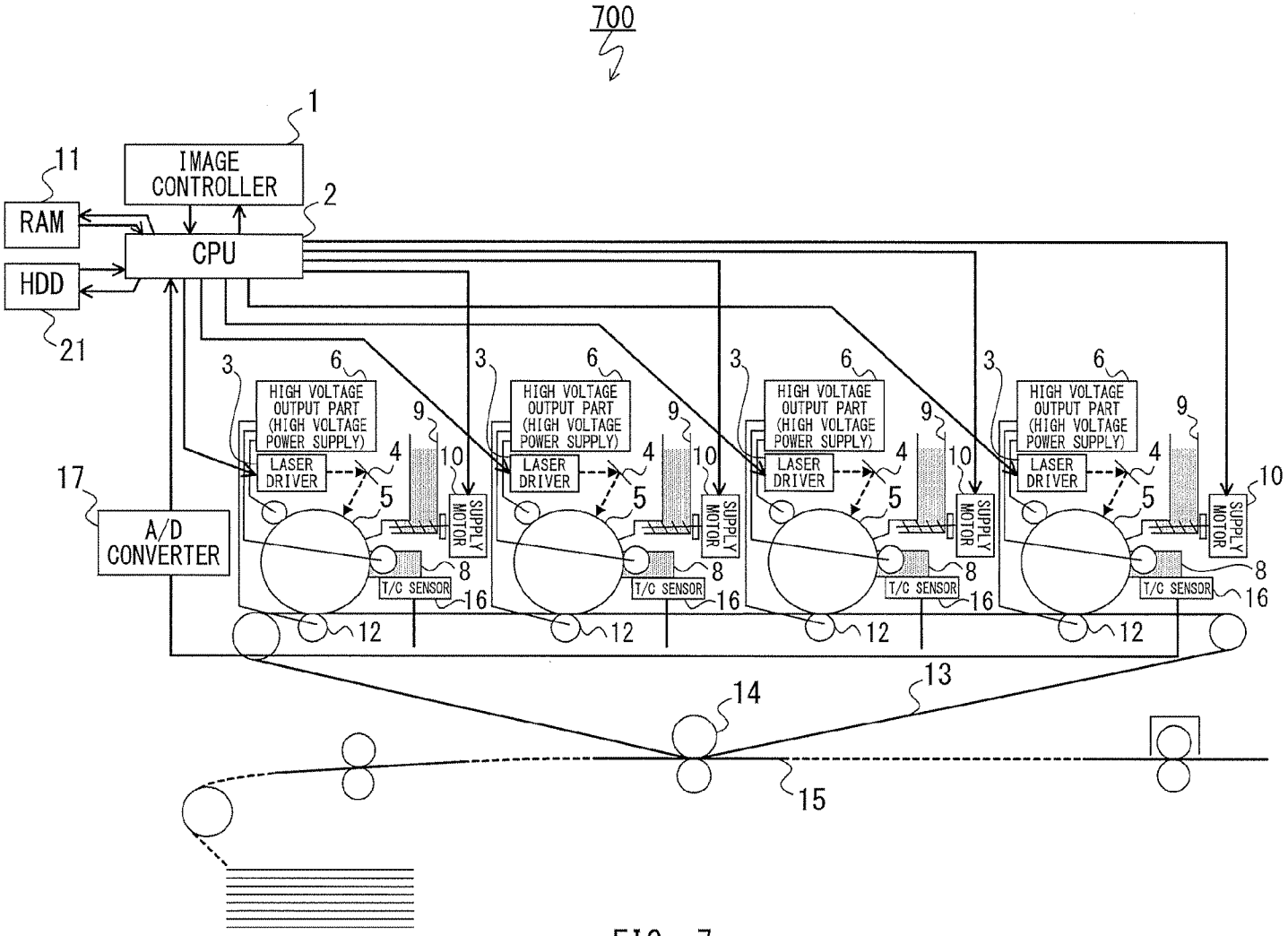
FIG. 7 is a schematic diagram showing an overall configuration of an image forming apparatus according to a second embodiment.

In a second embodiment described below, with a toner density sensor for detecting the toner density D in the developing device 8, the supply amount can be determined with more accuracy. To simplify the description, the same processing as that in the first embodiment is omitted. FIG. 7 shows a schematic diagram of an overall configuration of an image forming apparatus 700 in the second embodiment.

The image forming apparatus 700 shown in FIG. 7 comprises an A/D converter 17, which is different from the image forming apparatus 100 shown in FIG. 1A and FIG. 1B. Thereby, with regard to components which are in common with the image forming apparatus 100, the same reference numeral as that attached to the image forming apparatus 100 is also attached to the image forming apparatus 700 to omit its description. Further, to avoid complication of the drawing, descriptions of the image forming stations 101Y, 101M, 101C, and 101K are omitted. In the developing device 8 of the image forming apparatus 700 in the present embodiment, a toner density sensor 16 for detecting the toner density of the two-component developer is incorporated. The toner density sensor 16 is arranged in contact with the developer which circulates in the developing device 8. The toner density sensor 16 comprises a drive coil, a reference coil and a detection coil. The toner density sensor 16 outputs a signal in accordance with the magnetic permeability of the developer. When high frequency bias is applied to the drive coil, output bias of the detection coil changes in accordance with the toner density of the developer. By comparing the output bias of the reference coil which is not in contact with the developer with the output bias of the detection coil, the toner density of the developer is detected.

Using a conversion formula previously stored, the CPU 2 converts the detection result by the toner density sensor 16 into the toner density. Further, based on the measurement result of the toner density sensor 16, the CPU 2 obtains the toner density D by the following formula (6).

$$\text{Toner density } D=(SGNL \text{ value}-SGNLi \text{ value})/\text{Rate}+\text{initial } Di$$

SGNL value: Measurement value of the toner density sensor

SGNLi value: Initial measurement value of the toner density sensor (initial value)

Rate: Sensitivity

The initial toner density Di and the SGNLi value used are measured at initial setting. As the property of the toner density sensor 16, Rate represents the sensitivity of the ΔSGNL to the toner density D which is previously measured. These constants (initial value Di, SGNLi value, Rate) are stored in the RAM 11.

In general, the toner supply amount is determined from the difference between the detected toner density D and the target toner density Dt which is previously set. In the present embodiment, however, with the calculation using the formula which predicts the change in the toner particle charge amount as shown in the formula (2), the supply amount which prevents the change of the toner particle charge amount is calculated. Then, with the toner density which is achieved when supplying the toner as the target toner density Dt, the actual supply amount is determined from the difference between the detected toner density and the target toner density Dt. In the present embodiment, toner density D actually measured by a toner optical sensor is also used to the toner density D in the formula (2) which predicts the change in the toner particle charge amount. To convert from the toner density difference into the supply amount, a conversion table previously stored is used. Thereby, by using the actual measurement value of the toner density, even when the deviation is caused between the toner density value obtained by integrating the prediction result and the actual toner density due to a long term change, it is possible to determine the toner supply amount which prevents the change of the charge amount at the time step at that point with good accuracy.

In the first embodiment and the second embodiment, the toner supply amount will not vary by the rotation of the supply motor 10. However, there may be a case where a correlation between the rotation amount of the supply motor 10 and the toner supply amount changes for some reason and the estimated toner supply amount does not match with the actual toner supply amount. In this case, the actual toner supply amount is different from the estimated supply amount in value. Thereby, the actual toner density does not match with the expected toner density. Thereby, in a third embodiment described below, the correlation between the rotation amount of the supply motor 10 and the toner supply amount is corrected in the image forming apparatus 100 shown in FIG. 1A. Factors that the toner supply amount is deviated from the estimated amount include a change of toner fluidity due to the change of the environment where the image forming apparatus 100 is installed and slight toner leakage between the conveying screw 22 and its container. The factor of the deviation also includes variation due to individual difference of response time of a clutch which controls between the conveying screw 22/supply motor 10. Further, due to slight rotation by inertia when the rotation of the conveying screw 22 is off and the like, the toner supply amount may be deviated from the estimated amount. As mentioned, due to the situation and the configuration, the actual toner supply amount may largely be deviated from the estimated amount. Thereby, in the present embodiment, using the calculation value of the toner density D and the actual measurement value measured by the toner density sensor 16, a difference between the expected supply amount and the actual supply amount is obtained by the formula (4). Based on the difference in the supply amount, the relation between the toner supply amount and the rotation speed of the supply motor 10 is adjusted.

Here, the toner supply amount is defined as H and the rotation speed of the supply motor 10 per unit time is defined as R. Then, following formula is established.

$$R=k*e*H \tag{6}$$

Figure 8:
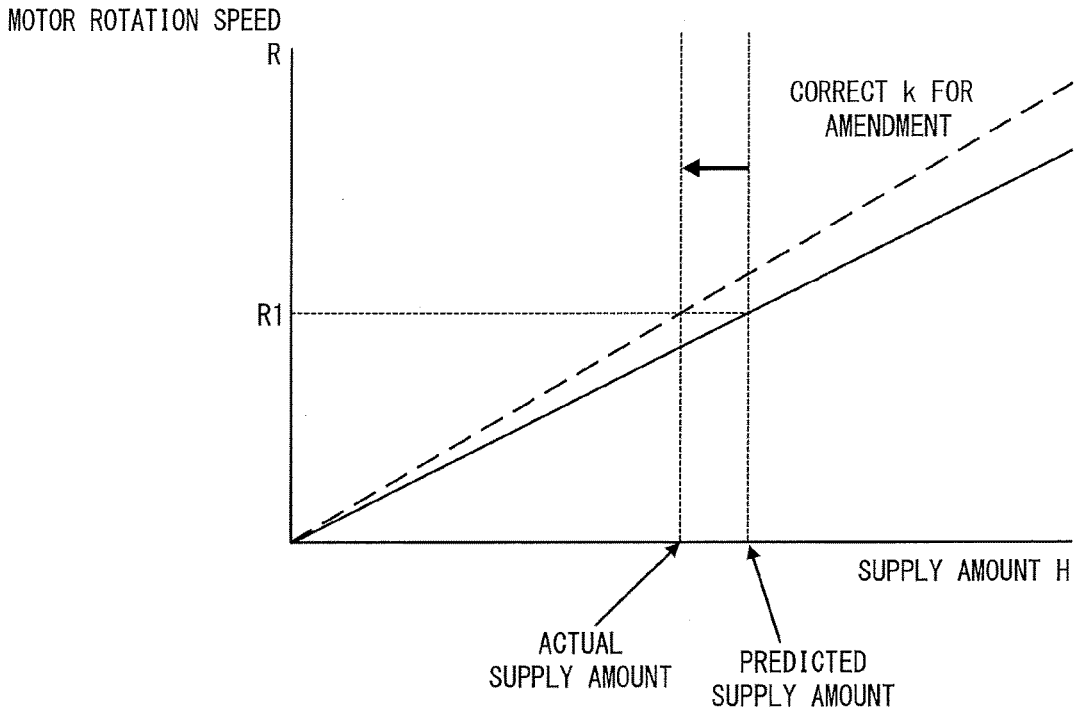
FIG. 8 is a graph showing a relation between the toner supply amount and rotation speed of a supply motor in a third embodiment.

Here, k represents an efficient. Relation between the supply amount and the rotation speed previously obtained by the experiment is represented by the coefficient of e. Using the difference in the supply amount actually detected, the value of k is changed so that the current toner supply amount matches the rotation speed of the supply motor 10. In FIG. 8, the supply motor rotation speed before correcting k in the formula (6) is shown by a graph of a solid line. Also, the toner supply amount after correcting k in the formula (6) is shown by a graph of a broken line. As shown in FIG. 8, by adjusting the coefficient k in the formula (6), a correlation formula which gets closer to the actual supply amount is obtained with regard to the toner supply amount H and the rotation speed R of the supply motor 10. Note that, here, a primary approximation method representing the relation by a primary formula is used, however, the relation may be defined in a table previously obtained by the experiment and the table may be corrected. In the present embodiment, one time step corresponds to the output of one image. Other method such as a secondary approximation method may be used.

Figure 9:
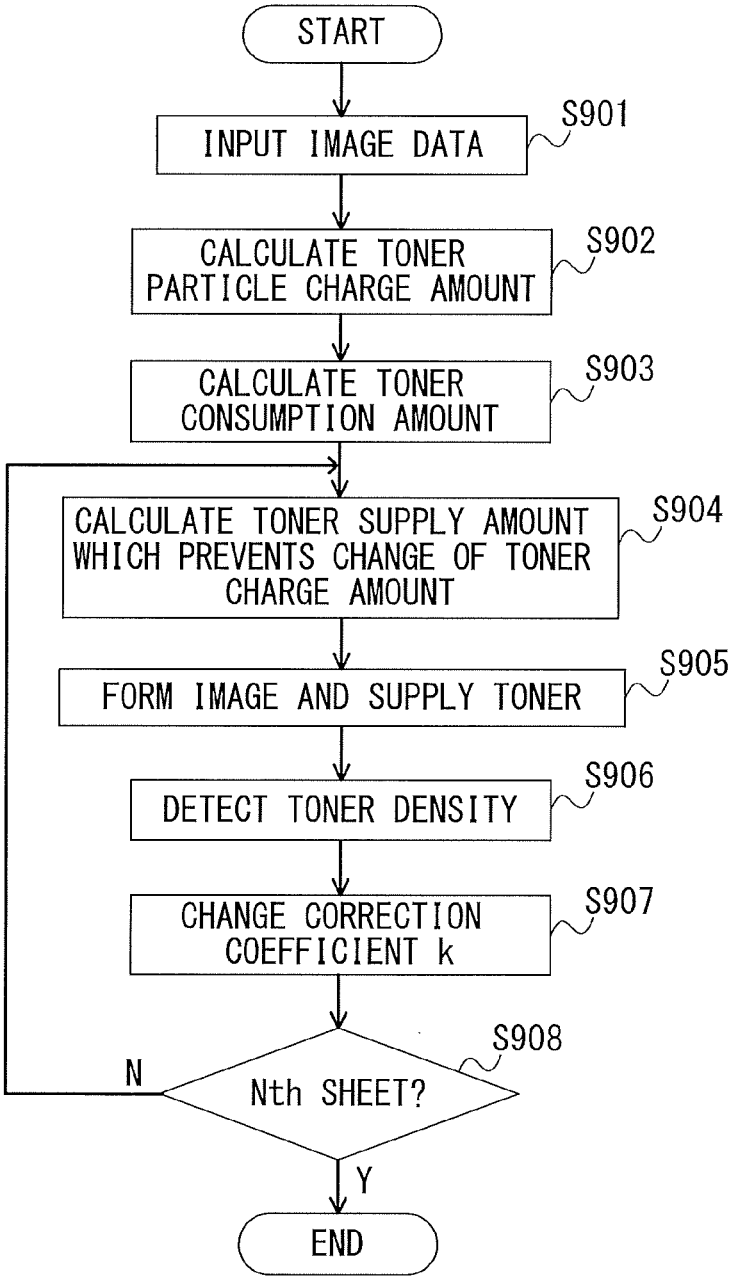
FIG. 9 is a flowchart for operation of determining the toner supply amount and operation of correcting a change in the toner supply amount.

Operation flow for determining the supply amount by the change amount prediction of the toner particle charge amount and for correcting the change in the supply amount by an actual measurement is described by a flowchart shown in FIG. 9. When the image data is input into the image controller 1 from the PC (Step S901), the CPU 2 calculates the toner particle charge amount at that point based on the integrated value of the change amount prediction of the toner particle charge amount (Step S902). In the present embodiment, the image data of N number of sheets is output. At this time, as the toner density D, a previous actual measurement value is used. Next, using the graph showing the relation between the image signal and the toner consumption amount as shown in FIG. 3, the CPU 2 calculates the toner consumption amount S in outputting the image data (Step S903). Thereafter, referring to the formula (2) which predicts the change in the toner particle charge amount, the CPU 2 calculates the supply amount which prevents the change of the charge amount in outputting the image data (Step S904). The supply amount for the image of the first sheet is calculated as H(1). After determining the supply amount, the CPU supplies the toner through the supply motor 10 to form the image and supply the toner (Step S905). At this time, to actually supply the calculated supply amount, the CPU 2 controls the rotation speed of the supply motor 10 using the correction coefficient k as shown in the formula (6). Note that, as to the image data of the first sheet, k=1. As to the image data after the second and succeeding sheets, using the correction coefficient k which is changed at Step S907 (described later), the CPU 2 controls the rotation speed of the supply motor 10.

After forming the image and supplying the toner, the CPU 2 detects the toner density D from the output value of the toner density sensor 16 (Step S906). Then, the CPU 2 calculates the difference in the supply amount from the difference between the detected toner density D and the predicted toner density D. Then, based on the result, the CPU 2 changes the supply motor rotation speed correction coefficient k (Step S907). Next, the CPU 2 determines whether the image data is for the Nth sheet or not (Step S908). If it is determined that the image data is not for the Nth sheet (Step S908: N), the CPU 2 returns to the processing of Step S904. In the Step S904, the supply amount for the image of the second sheet, the third sheet, and the Nth sheet is respectively calculated as H(2), H(3) and H(N). Further, when determining the supply amount of the image from the first sheet to the Nth sheet, the consumption amount S does not change. If it is determined that the image data is for the Nth sheet (Step S908: Y), the CPU 2 forms the image and ends the processing thereafter. Note that unless the image data changes, the consumption amount S does not change. In the present embodiment, for convenience, for every output of one sheet of the image data, the supply amount is calculated and the supply motor rotation speed correction coefficient k is changed. However, the timing to calculate the supply amount may be different from the timing to change the supply motor rotation speed correction coefficient k. For example, the supply amount may be calculated for every output of one sheet of the image data whereas the supply motor rotation speed correction coefficient k may be changed only once after performing the image formation for the image data of the first sheet in the processing shown in FIG. 8.

As mentioned, in the present embodiment, it is possible to maintain the toner particle charge amount constant by determining the supply amount to prevent the change of the charge amount and also correcting the change in the supply amount by using the formula which predicts the change in the charge amount. So, in the secondary/tertiary color, stable and high quality output can be obtained. In particular, the color deviation is compared in a case where the conventional method in which the image formation potential contrast is changed from the toner particle charge amount prediction is used and in a case where the method in accordance with the present embodiment is used. In the comparison, after outputting 1000 sheets with the high image ratio (C:100%, M:100%), 1000 sheets with the low image ratio (C:5%, M:5%) are output. The color deviation for a single color (C, M) at this time is about $\Delta E=2.5$ in the conventional method and the method in accordance with the present embodiment, which does not have any difference therebetween. On the other hand, with regard to the color deviation in the secondary color (Blue), in the conventional method, the color deviation ΔE=5, whereas in the method in accordance with the present embodiment, it is improved to ΔE=3.

In the embodiment as mentioned, the toner particle charge amount is maintained constant by changing the toner density by adjusting the supply amount. However, if the change amount of the toner density is large, defective image may be output. Thereby, in a fourth embodiment described below, the change amount of the toner density is controlled using a toner density detection value. In a case where a calculated toner density target value changes in excess of threshold, the change amount of the actual toner density is controlled with the threshold. To cope with the change in the toner particle charge amount in excess of the threshold, the conventional art of changing the image forming condition is used. As mentioned, in the fourth embodiment, the toner particle charge amount is predicted. Then, using the prediction result, correction control is performed. Then, in a case where the change in the toner particle charge amount in excess of the threshold is calculated, the toner density is not changed in excess of the threshold. For the change in excess of the threshold, gradation conversion correction is applied to the image data for compensation.

Figure 10A:
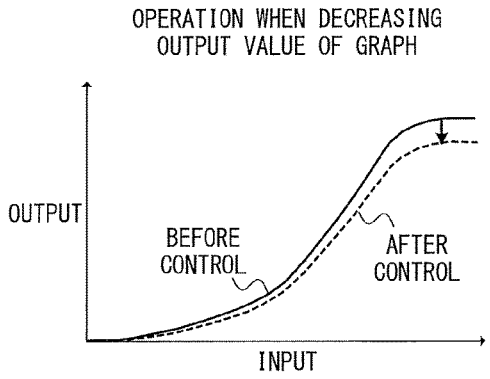
FIG. 10A and FIG. 10B are graphs showing operation in a case where an output value in a fourth embodiment is changed.

The fourth embodiment is similar to the second embodiment with regard to the flow until the target of the toner density is determined. However, in a case where the change amount of the calculated target toner density Dt from the original toner density varies in excess of the threshold, the toner density is set to be a value below the threshold and the toner density will not be not changed in excess of the threshold. The value which is controlled with the threshold in this manner is defined as a corrected target value. Next, the toner particle amount to be supplied is determined by predicting the toner particle charge amount by applying the toner density of the corrected target value to the formula (2). In a case where the target toner density rapidly becomes large and the variation is controlled with the threshold, the change in the density in excess of the threshold is compensated by performing the gradation conversion correction. In particular, in a case where the toner density rapidly becomes small, the corrected target value obtained by controlling the variation amount with the threshold is applied to the formula (2). In this manner, with the threshold, it is controlled so that the toner density does not rapidly become small. As a result, the obtained corrected target value becomes larger than the original value. Thereby, a gradation conversion output to the image data input is made small. FIG. 10A shows the correlation of the gradation output to the image data input.

Figure 10B:
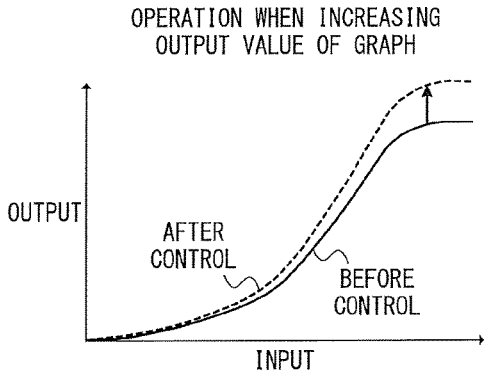

In a case where the toner density rapidly becomes large, the corrected target value obtained by controlling the variation amount with the threshold is applied to the formula (2). In this manner, with the threshold, it is controlled so that the toner density does not rapidly become large. As a result, the obtained corrected target value becomes smaller than the original value. Thereby, the gradation conversion output to the image data input is made large. FIG. 10B shows the correlation of the gradation output to the image data input. In FIG. 10A, a graph of a solid line represents the output value before the control. A graph of a broken line represents the output value after the control. The output value after the control is smaller than the output value before the control over all regions. Also, in FIG. 10B, a graph of a solid line represents the output value before the control. A graph of a broken line represents the output value after the control. The output value after the control is larger than the output value before the control over all regions. As mentioned, in the present embodiment, even the toner density largely changes, the variation amount is controlled with the threshold, which enables to prevent the defective image from being output. Further, the variation in excess of the threshold is corrected by the gradation correction so that the image of desired density can be obtained.

In the third embodiment, in a case where the supply amount is changed by the rotation speed of the supply motor, the charge amount is stabilized by correcting the relation and improving the accuracy of the supply. In a fifth embodiment described below, however, a description is provided with regard to processing in a case where variation is caused in correlation between the motor rotation speed and the supply amount and it is difficult to correct the relation. Further, a description is also provided with regard to performing calibration of the charge amount prediction (hereinafter, referred to as charge amount calibration) by forming a patch image and detecting the density of the formed image to correct deviation of the prediction in the charge amount prediction.

In the following description, description with regard to the component similar to that of the first embodiment is omitted and the difference therebetween is only described. In the present embodiment, timing to perform the charge amount calibration is determined by a change of the supply motor rotation speed correction coefficient k. It means that, the relation between the motor rotation speed and the supply amount varies with no tendency. When the supply accuracy cannot be maintained, the change amount prediction value gradually deviates from the actual charge amount. Thereby, when the change of the supply motor rotation speed correction coefficient k is large, the timing to perform the calibration of the charge amount prediction is accelerated to improve the accuracy of the charge amount prediction. The charge amount calibration is performed by detecting the density of the image formed on the intermediate transfer belt 13 and obtaining the actual toner particle charge amount.

Figure 11:
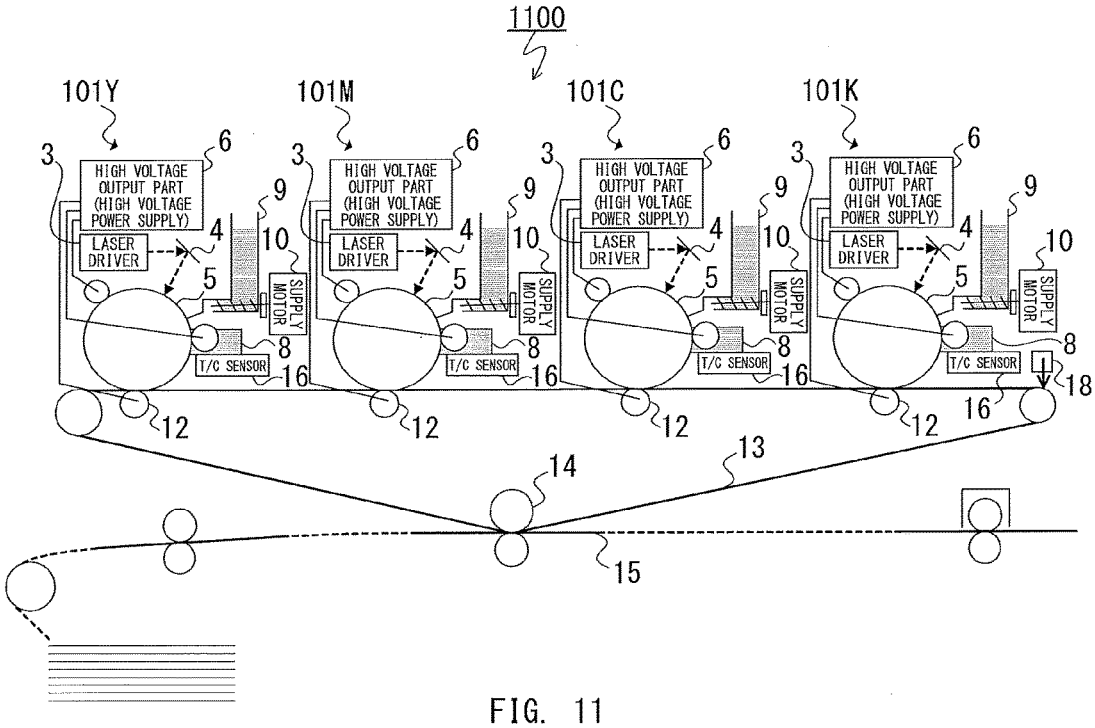
FIG. 11 is a schematic diagram showing an overall configuration of an image forming apparatus according to a fifth embodiment.
Figure 12:
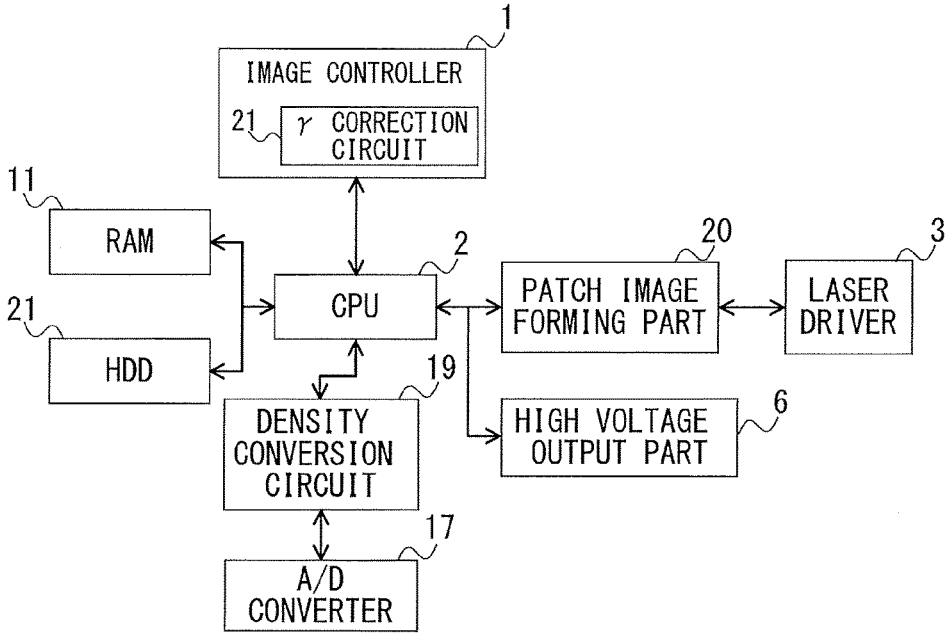
FIG. 12 is a block diagram showing an overall configuration of the image forming apparatus according to the fifth embodiment.

FIG. 11 is a schematic diagram showing an overall configuration of an image forming apparatus 1100 according to the present embodiment. FIG. 12 is a block diagram showing an overall configuration of the image forming apparatus 1100 according to the present embodiment. In the present embodiment, the density of the toner image formed by the development is detected by the optical sensor. As shown in FIG. 11, in the present embodiment, the image forming apparatus 1100 is provided with an image density sensor 18 for detecting the density of a reference toner image (hereinafter, referred to as a patch image) formed on the intermediate transfer belt 13 by the development. In the present embodiment, the patch image is formed on the intermediate transfer belt. However, the patch image is not limited to the toner image formed on the intermediate transfer belt. For example, the density of the image after fixing may be detected.

The image forming apparatus 1100 shown in FIG. 11 is different from the image forming apparatus 100 shown in FIG. 1A in that it comprises the image density sensor 18. Other components are in common with the image forming apparatus 100 shown in FIG. 1A. Thereby, with regard to the component which is the same as that of the image forming apparatus 100 shown in FIG. 1A, the same reference numeral is attached in FIG. 11 and the description is omitted. As shown in the functional block diagram of FIG. 12, similar to the functional block diagram of the image forming apparatus 100 of FIG. 1B, the image forming apparatus 1100 comprises the image controller 1, the CPU 2, the laser driver 3, the RAM 11, and the HDD 21. The image forming apparatus 1100 further comprises a patch image forming part 20 provided between the CPU 2 and the laser driver 3, a density conversion circuit 19 and an A/D converter 17.

As shown in FIG. 11, the image density sensor 18 is arranged downstream of the respective image forming stations 101Y, 101M, 101C, and 101K. After performing the image formation in each color of yellow, magenta, cyan and black, the image density sensor 18 detects the density. The image density sensor 18 comprises four photo sensors in total consisting of LED and photo diode which are opposite to a surface which carries the toner on the intermediate transfer belt 13.

Reflected light from the intermediate transfer belt 13 is made incident to the image density sensor 18 of the image forming apparatus 1100 shown in FIG. 11. The density sensor 18 converts the reflected light which is made incident into an electric signal. In the present embodiment, an output voltage of 0 to 5 V is output from the image density sensor 18 in accordance with the detected density. The electric signal from the image density sensor 18 is input into the A/D converter 17 shown in FIG. 12, converted into a digital signal of 0 to 1023 level, and input into the density conversion circuit 19. The density conversion circuit 19 converts the input digital signal into the density to obtain the actual measurement value of the image density of the reference image. The CPU 2 obtains the actual measurement value of the image density from the image density sensor 18 through the A/D converter 17 and the density conversion circuit 19. The charge amount calibration can be performed after a predetermined number of sheets are output. Usually, the charge amount calibration is regularly performed. For example, regardless of a paper size, for every output of 1000 sheets of the image data, the CPU 2 performs one charge amount calibration. In this method, however, in a case where the variation or the change is caused in the correlation between the motor rotation speed and the supply amount for some reason, the supply amount as intended may largely deviate from the actual supply amount.

In the present embodiment, similar to the third embodiment, the supply motor rotation speed correction coefficient k is calculated for every output of one sheet of image data. Then, in accordance with the change of the calculated supply motor rotation speed correction efficiency k, timing to perform the charge amount calibration is adjusted. Any method can be used to adjust the timing. Further, similar to the second embodiment, the supply motor rotation speed correction coefficient k is calculated for every output of one sheet. Then, in a case where an average of the change amount of the supply motor rotation speed correction coefficient k for last 10 times ($\Delta k_{ave}$) exceeds a predetermined value and the output sheets exceed the predetermined number of sheets, performance frequency of the charge amount calibration is made higher.

In particular, a count value of the output sheets of the image data from a start of the image formation is defined as n and a value of k in the count value n is defined as $k_n$. Further, the value of k in last 10 times of $K_n$ is defined as $k_{n-10}$, $k_{n-9}$, . . . , $k_{n-2}$, and $k_{n-1}$. Then, the change amount of k, Δk is defined as $\Delta k_n = k_n - k_{n-1}$, $\Delta k_{n-1} = k_{n-1} - k_{n-2}$, . . . , and $\Delta k_{n-9} = k_{n-9} - k_{n-10}$. The average of the change amount of k, Δk can be expressed as follows. $\Delta k_{ave} = (\Delta k_n + \Delta k_{n-1} + \Delta k_{n-2} \ldots + \Delta k_{n-9})/10$ It is determined whether the $\Delta k_{ave}$ exceeds the predetermined value or not. In the present embodiment, it is determined whether the value of $\Delta k_{ave}$ exceeds 0.1 or not. Then, the performance frequency of the charge amount calibration is changed from once for every output of 1000 sheets to once for every output of 500 sheets. Note that, in a case where the $\Delta k_{ave}$ exceeds 0.1, the charge amount calibration is performed after the count value of the output sheets reaches 500 after the previous charge amount calibration is performed. Note that, in a case where the count value of the output sheets already exceeds 500 after the previous charge amount calibration is performed when $\Delta k_{ave}$ turns 0.1, the charge amount calibration is performed at that point. Thereby, when $\Delta k_{ave}$ exceeds 0.1, the charge amount calibration is performed when the output count value is more than 500.

Figure 13:
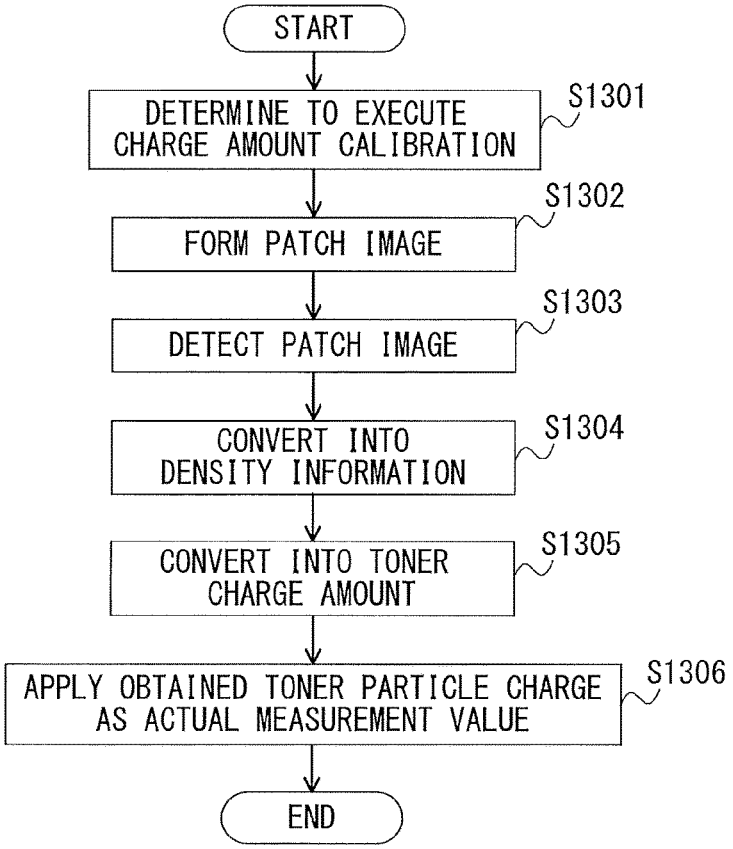
FIG. 13 is a flowchart showing a flow of charge amount calibration in the fifth embodiment.

FIG. 13 shows flow of the charge amount calibration in this embodiment. Unless otherwise stated, the CPU 2 of the image forming apparatus 1100 executes each step in the flow. The CPU 2 determines to execute the charge amount calibration in a case where the count value of the output sheets reaches 1000 or in a case where $\Delta k_{ave}$ exceeds 0.1 and the output count value is more than 500 as mentioned (Step S1301). Thereafter, the CPU 2 forms a patch image on the intermediate transfer belt 13 from a pattern formed in the patch image forming part 20 (Step S1302). An image forming condition is a fixed condition. In the present embodiment, developing contrast to a patch electrostatic image is 100 V. The patch image formed in the present embodiment is a test pattern, the size of which is 15 mm in a main scanning direction and 25 mm in a sub-scanning direction which is an image proceeding direction. The patch image is a monochromatic solid image. Each color of the patch image consists of 100% image signal. The CPU 2 detects the formed patch image through the image density sensor 18 which operates as an image optical sensor (Step S1303).

Figure 14:
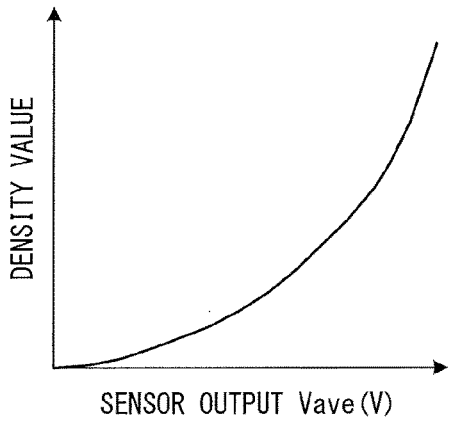
FIG. 14 is a graph showing a relation between a sensor output and density in the fifth embodiment.

In the present embodiment, the CPU 2 performs sequential detection of the patch image at 25 points of the patch image for every 2 ms to obtain a detection value of each point. Thereafter, the CPU removes a maximum value and a minimum value of the detection value for the obtained 25 points. Then, the CPU 2 converts an average value $V_{ave}$ of the detection value for the rest of the 23 points into the patch density (Step S1304). The conversion from the average value $V_{ave}$ of the detection value into the density information is performed using a predetermined correlation formula. FIG. 14 shows a graph representing correlation used in the present embodiment. In FIG. 14, the horizontal axis of the graph represents a sensor output $V_{ave}$ V and the vertical axis of the graph represents the density value. As shown, as the sensor output increases, the density value acceleratingly increases. The graph has a downwardly projecting shape.

Figure 15:
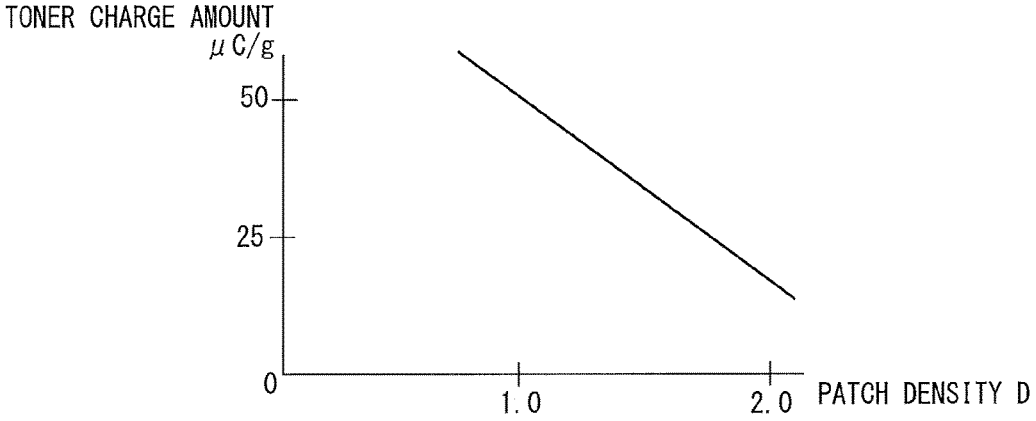
FIG. 15 is a graph showing a relation between the patch density and the toner particle charge amount in the fifth embodiment.

Next, based on the patch density obtained by referring to the graph in FIG. 14, the CPU 2 calculates the toner particle charge amount (Step S1305). The conversion from the patch density into the toner particle charge amount is performed using a predetermined correlation formula. FIG. 15 shows a graph representing the correlation between the patch density and the toner particle charge amount used in the present embodiment. In FIG. 15, the horizontal axis of the graph represents patch density D and the vertical axis of the graph represents the toner particle charge amount μC/g. As shown in FIG. 15, the toner particle charge amount is almost in linear relation with the patch density D. As the patch density D becomes high, the toner particle charge amount reduces.

When a patch electrostatic latent image is fixed, the patch density largely depends on the toner particle charge amount. So, the toner particle charge amount can be obtained from the patch density using the correlation shown in the graph in FIG. 15. Applying the obtained toner particle charge amount as the actually measured toner particle charge amount (Step S1306), the CPU 2 ends the charge amount calibration. Thereafter, by performing prediction calculation of the toner particle charge amount for the next timing using this value as the previous value, it is possible to improve the prediction accuracy of the charge amount.

Further, in the above formulas (2) and (3), the image forming apparatus 100 can change the parameters α and β based on the toner density and can change the parameters α and γ based on the environment humidity in the image forming apparatus. Other configuration and control mode are the same. The CPU 2 stores the output value of the toner density sensor 16 (obtain time average in a period between the time steps) and a detection value of the environment sensor 27 (for example, detection result of absolute moisture) in the RAM 11.

The CPU 2 detects the toner density based on the output value of the toner density sensor 16. When the toner density is lowered, the CPU 2 reduces the value of α and increases the value of β in the formulas (2) and (3). On the other hand, when the toner density becomes high, the CPU 2 increases the value of α and reduces the value of β in the formulas (2) and (3). When the toner density does not change, the CPU 2 does not change the values of α and β.

Next, the CPU 2 detects the environment humidity from the detection value of the environment sensor 27. When the environment humidity becomes high, the CPU 2 reduces the values of α and γ in the formulas (2) and (3). On the other hand, when the environment humidity becomes low, the CPU 2 increases the values of α and γ in the formulas (2) and (3). When the environment humidity does not change, the CPU 2 does not change the values of α and γ.

It means that, when the toner density becomes high, the CPU 2 changes the parameter so that the toner charge amount (prediction value) is calculated to be the smaller value. Also, when the environment humidity becomes high, the CPU 2 changes the parameter so that the speed of the friction charge (electrostatic discharge) is calculated to be slow. Or when the environment humidity becomes high, the CPU 2 may change the parameter so that the toner charge particle amount (prediction value) is calculated to be the smaller value.

The time speed at which the friction charge of the toner particle is performed and the time speed of the charge leakage from the toner particle change in accordance with the toner density and the environment humidity. With the above configuration, such change can properly be adjusted. By performing such adjustment, even in a case where the installation environment of the image forming apparatus is changed so that the change property of the toner change amount is changed, it is possible to correspond to the change of the property to predict the toner particle charge amount with less error.

Note that the parameter may be corrected based on one of the toner density and the environment humidity.

In the above description, the description is provided with regard to adjusting the supply amount by changing the rotation speed of the supply motor 10. However, the supply amount may be adjusted based on the rotation number of the stirring screw 22. In this case, the CPU 2 controls the rotation number of the stirring screw 22 based on the supply amount. The supply amount of the stirring screw 22 for one rotation is previously determined. Thereby, the CPU 2 causes the motor 10 to rotate the stirring screw 22 every time the calculated supply amount becomes the predetermined amount.

As mentioned, according to the present disclosure, it is possible to suppress the variation in the toner particle charge amount. Thereby, even in a case where the variation in the toner particle charge amount gives influence on the transfer property in the image formation, it is possible to properly perform the image formation by suppressing the variation in the toner particle charge amount.

Further, according to the present disclosure, it is possible to perform the stable image formation even in a case where the transfer property is influenced by the toner particle charge amount by suppressing the variation in the toner particle charge amount to maintain the toner particle charge amount constant. In particular, in the secondary/tertiary color on which toner of one or more colors are overlapped, stable and high quality output can be achieved. The present disclosure is not limited to the embodiment as mentioned but can be performed in various modes. For example, in the embodiment as mentioned, the image density sensor 18 detects the density of the patch image formed on the intermediate transfer belt. However, the patch image is not limited to the toner image formed on the intermediate transfer belt. For example, the image density sensor 18 may detect the density of the image after fixing the toner image on the sheet and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-213694, filed Oct. 30, 2015 which is hereby incorporated by reference herein in its entirety.

What is claimed is:

1. An image forming apparatus comprising:

a photoreceptor;

an exposure unit configured to expose the photoreceptor based on image data to form an electrostatic latent image on the photoreceptor;

a developing unit, having a rotating member configured to rotate to charge a developer including toner, configured to develop the electrostatic latent image formed on the photoreceptor using the developer;

a sensor configured to detect a density of the toner in the developing unit;

a supply unit configured to supply toner to the developing unit; and a controller configured to control, based on (i) a rotation time of the rotating member, (ii) a detection result of the sensor, and (iii) a consumption amount, the supply unit to restrict a change amount of a charge amount of the toner in the developing unit to a predetermined range.

2. The image forming apparatus according to claim 1, wherein the controller controls the supply unit based on (i) the rotation time of the rotating member, (ii) the detection result of the sensor, (iii) the consumption amount, and (iv) a stop time during which the rotating member stops the rotation.

3. The image forming apparatus according to claim 2, wherein the change amount corresponds to sum of an increase amount and a decrease amount of the charge amount, wherein the controller determines the increase amount of the charge amount based on (i) the rotation time of the rotating member, (ii) the detection result of the sensor, and (iii) the consumption amount, and wherein the controller determines the decrease amount of the charge amount based on (iv) the stop time.

4. The image forming apparatus according to claim 1, further comprising an environment sensor configured to obtain environment information in the image forming apparatus, wherein the controller controls the supply unit based on (i) the rotation time of the rotating member, (ii) the detection result of the sensor, (iii) the consumption amount, and (iv) the environment information obtained by the environment sensor.

5. The image forming apparatus according to claim 1, wherein the sensor measures magnetic permeability of the developer to detect the density of the toner in the developer.

6. The image forming apparatus according to claim 1, wherein the controller determines the consumption amount based on the image data.

7. The image forming apparatus according to claim 1, wherein the controller determines the change amount of the charge amount of toner in the developing unit based on (i) the rotation time of the rotating member, (ii) the detection result of the sensor, and (iii) a consumption amount, and wherein the controller controls the supply unit to restrict the change amount of the charge amount of the toner to the predetermined range.

8. The image forming apparatus according to claim 7, wherein the controller determines the change amount of the charge amount of toner in the developing unit based on (i) the rotation time of the rotating member, (ii) the detection result of the sensor, (iii) the consumption amount, and (iv) a previous charge amount of toner.

9. The image forming apparatus according to claim 8, further comprising a measuring unit configured to measure a measurement image formed by the exposure unit and the developing unit, wherein the controller determines the previous charge amount of the toner based on the measurement result of the measurement image by the measuring unit.

10. The image forming apparatus according to claim 1, wherein the controller determines a target density of the toner in the developing unit based on (i) the rotation time of the rotating member, (ii) the detection result of the sensor, and (iii) the consumption amount, and wherein the controller controls the supply unit based on the target density of the toner and the detection result by the sensor.

* * * * *